US010991234B2

(12) United States Patent
Okcun

(10) Patent No.: US 10,991,234 B2
(45) Date of Patent: Apr. 27, 2021

(54) SHUTTER TEST DEVICE FOR FLAME/FIRE DETECTORS

(71) Applicant: Nero Endustri Savunma Sanayi Anonim Sirketi, Istanbul (TR)

(72) Inventor: Alican Okcun, Ankara (TR)

( * ) Notice: Subject to any disclaimer, the term of this patent is extended or adjusted under 35 U.S.C. 154(b) by 0 days.

(21) Appl. No.: 16/712,139

(22) Filed: Dec. 12, 2019

(65) Prior Publication Data

US 2021/0056835 A1 Feb. 25, 2021

(30) Foreign Application Priority Data

Aug. 21, 2019 (TR) ..... 2019/12530

(51) Int. Cl.

| | |
|---|---|
| ***G08B 17/10*** | (2006.01) |
| ***G08B 29/14*** | (2006.01) |
| ***G08B 17/107*** | (2006.01) |
| ***F23M 11/04*** | (2006.01) |

(52) U.S. Cl.
CPC ..... *G08B 29/145* (2013.01); *F23M 11/045* (2013.01); *G08B 17/107* (2013.01)

(58) Field of Classification Search
CPC ..... G08B 29/145; G08B 17/07; F23M 11/045
USPC ..... 340/628
See application file for complete search history.

(56) References Cited

U.S. PATENT DOCUMENTS 4,451,785 A * 5/1984 Rozniecki ..... G08B 29/145 136/290
4,529,881 A 7/1985 Ceurvels et al.
4,578,583 A * 3/1986 Ciammaichella ..... F23N 5/082 250/372
4,823,114 A * 4/1989 Gotisar ..... G08B 17/12 340/578
4,827,244 A * 5/1989 Bellavia ..... G08B 29/145 340/514
5,059,124 A * 10/1991 Tsujita ..... G09B 9/00 434/226
6,838,988 B2 * 1/2005 Lennartz ..... G08B 29/145 340/539.26
8,797,531 B2 * 8/2014 Knox ..... H01L 29/1029 356/337
8,810,387 B2 * 8/2014 Hall ..... G08B 29/12 340/514
9,905,102 B2 * 2/2018 Fischer ..... G01N 21/53
(Continued)

FOREIGN PATENT DOCUMENTS

WO 2006125936 A1 11/2006

*Primary Examiner* — Zhen Y Wu
(74) *Attorney, Agent, or Firm* — Egbert Law Offices, PLLC

(57) ABSTRACT

A shutter test device is provided for determining whether or not detectors detecting flame spectrum at UV and IR wave lengths by forming virtual flame/fire spectrum work, and estimating detection time per milliseconds, estimating the time period in which tubes explode, as well as the time period in which the fire extinguishing system works. The shutter provides or prevents delivery of light source radiations to the detector under control of the control unit. The control unit receives alarm signal generated by detectors detecting sent radiation via cable or wireless estimates response time activated as a result of alarm signal and tests working of the fire extinguishing system subject to said alarm, and the activation period, and calculates the time period of activation.

8 Claims, 2 Drawing Sheets

(56) References Cited

U.S. PATENT DOCUMENTS

| | | | | |
|---|---|---|---|---|
| 10,152,878 | B2 * | 12/2018 | Eichler | G08B 29/123 |
| 2004/0217857 | A1 * | 11/2004 | Lennartz | G08B 29/145 340/514 |
| 2009/0098492 | A1 * | 4/2009 | Chiu | F23K 5/005 431/6 |
| 2009/0140868 | A1 * | 6/2009 | Booth | G08B 17/10 340/628 |
| 2012/0140231 | A1 * | 6/2012 | Knox | H01L 29/7786 356/442 |
| 2015/0213697 | A1 * | 7/2015 | Knox | G08B 17/10 382/103 |
| 2016/0328936 | A1 * | 11/2016 | Fischer | G01N 21/53 |
| 2018/0136364 | A1 * | 5/2018 | Kare | H02J 50/30 |

* cited by examiner

SHUTTER TEST DEVICE FOR FLAME/FIRE DETECTORS

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The invention relates to a shutter test device for determining whether or not detectors forming virtual flame/fire spectrum and detecting a flame spectrum at UV and IR wave lengths work, and estimating detection time per mil seconds, estimating the time period in which tubes explode, as well as the total time period in which system becomes active.

2. Description of Related Art Including Information Disclosed Under 37 CFR 1.97 and 37 CFR 1.98

In the prior art, UV and IR light sources are integrated into a test lamp and used for testing UV/IR sensors. However, it is almost impossible to estimate the time period in which the detectors react to said light sources and, the time period in which tubes discharged actively after warning, and in general the time period in which the system becomes active. In addition, it is required to use a shutter test device/lamp which is not portable and integrating to a system and needing intermediate components to measure the cases.

U.S. Pat. No. 4,529,881A relates to a flame detector comprising an adjustable view angle and test lamp. The flame detector comprises a housing, an observation window located in the house and a sensor located in a manner to view outside area from observation window. In addition, it comprises a test lamp performing test simulation of the detector in said housing. As described above, test lamp is used in a form wherein it is integrated into flame detector. For that reason, it is mostly impossible to obtain efficient measurement data. On the other hand, no shutter or equivalent component to control radiation of light sources is mentioned.

In the related art, the application numbered WO206125936A1 relates to a flame detector comprising a test source for electromagnetic radiation. Said test source and related sensor are in a housing inside a detector. The source is located in a manner to radiate in line with the sensor and thus tests for flame can be made without need for any outer test source. However, such embodiment is not able to estimate alarm and activation times and does not mention an embodiment like a shutter etc. to help it.

As a result, due to above described disadvantages and inadequacy of existing solutions, it has been necessary to make development in the related art.

BRIEF SUMMARY OF THE INVENTION

The main purposes of the invention are to determine whether or not detectors detecting flame spectrum formed in UV and IR wave lengths by forming virtual flame/fire spectrum work, and to determine how many milliseconds it takes to conduct detection, as well as the time period in which tubes explode. Required tests of detectors used for flame/fire detection systems and their tubes are conducted.

Contrary to test lamps in the related art, a portable device is hereby disclosed. Preferably, with a test lamp operated by a 24V external power supply the time in which reaction to radiation after opening of shutter can be measured by data displayed on a screen such as an LCD for UV and IR sources located behind a shutter thanks to its mechanical and software features as a result of radiation made towards the sensors.

On the other hand, due to the start button of the test lamp, both electric line of lamp and shutter system is supplied. Thus, the time of opening of the shutter is taken as t0 time and the time in milliseconds in which detectors run is tested without need for an extra installation.

The structural and characteristic features and all advantages of the invention will be understood better in the figures given below and the detailed description by reference to the figures. Therefore, the assessment should be made based on the figures and considering the detailed descriptions.

BRIEF DESCRIPTION OF THE SEVERAL VIEWS OF THE DRAWINGS

The drawings are not necessarily scaled and the details not necessary for understanding the present invention might have been neglected. In addition, the components which are equivalent to a great extent at least or have equivalent functions at least have been assigned the same number.

DESCRIPTION OF PART REFERENCES

Figure 1:
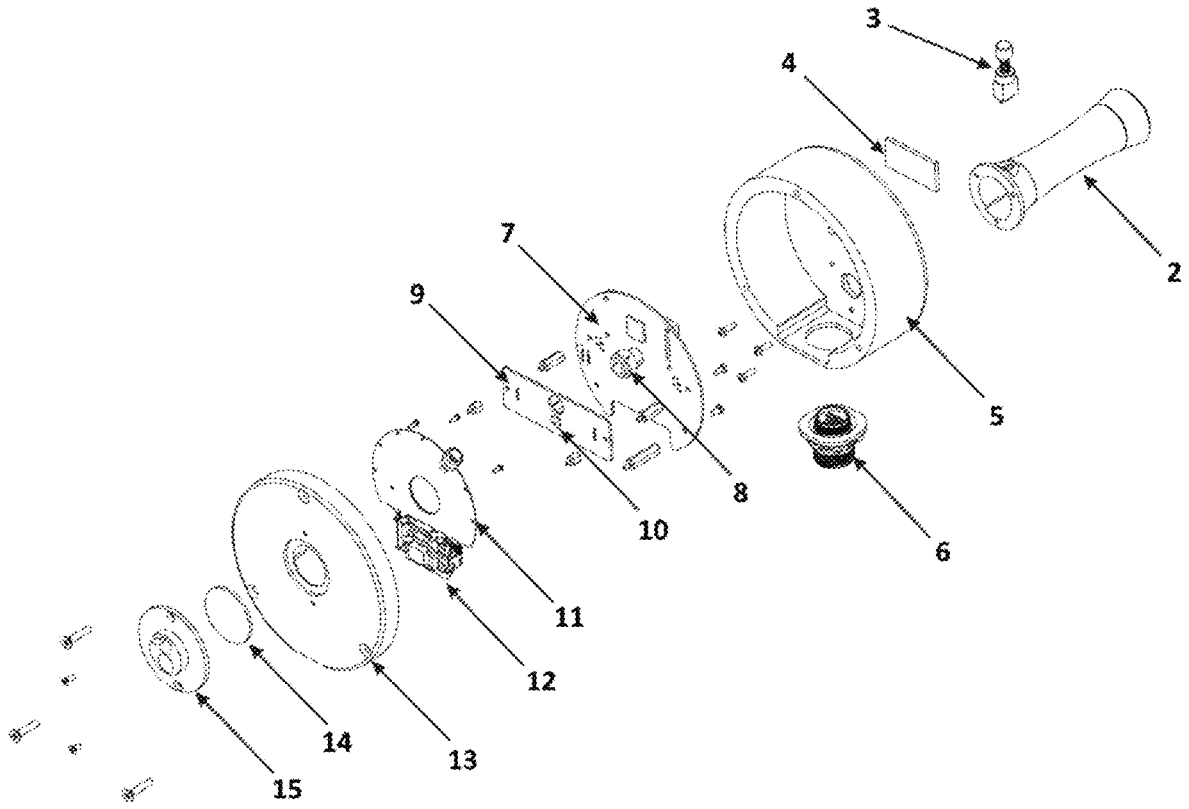
FIG. 1 is an exploded view of the test device of the invention.
Figure 2:
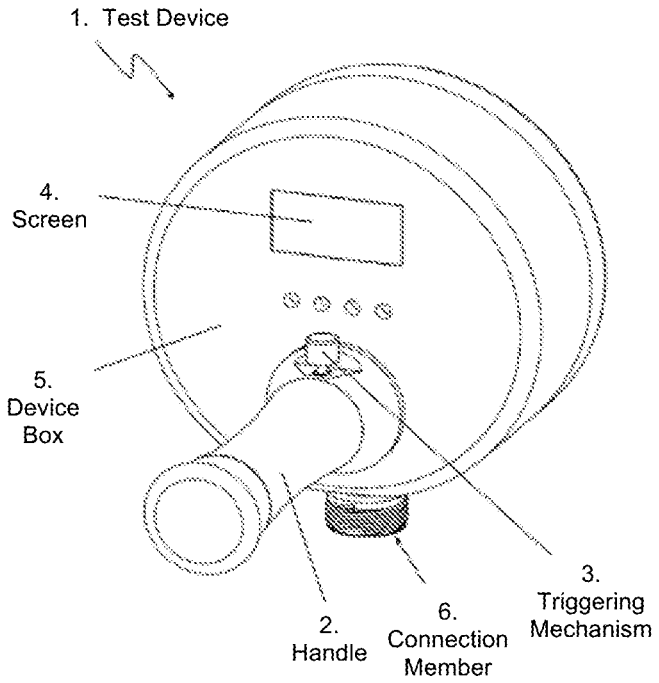
FIG. 2 is a perspective view of the test device of the invention in mounted form.
Figure 3:
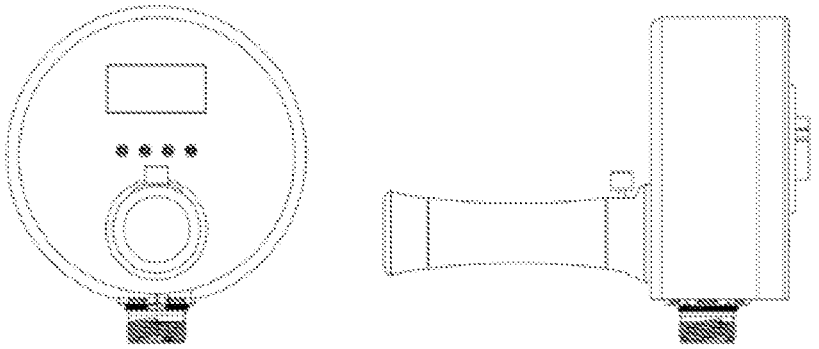
FIG. 3 is front and profile view of test device of the invention.

1. Test device
2. Handle
3. Triggering mechanism
4. Screen
5. Device box
6. Connection member
7. Alarm detection and measurement circuit
8. IR light source
9. UV light source card
10. UV light source
11. Shutter
12. Shutter driver circuit
13. Front Lid
14. Glass
15. Lock

DETAILED DESCRIPTION OF THE INVENTION

In this detailed description, the preferred embodiments of the invention have been described in a manner not forming any restrictive effect and only for purpose of better understanding of the matter.

The test device (1) of the invention controls whether or not detectors detecting flame spectrum generating at UV (ultraviolet) and IR (Infrared) wavelengths work, as well as estimates the time period in which tubes become active and total system activation as a consequence thereof and comprises following components:

- IR and/or UV light sources making radiation at different wavelengths that can be detected by sensors in the detectors to be tested and having flame spectrum;
- a shutter (11) located in front part of light sources, which controls reach of radiations of light sources to detectors by opening and closing;
- a unit receiving alarm signal generated by detectors perceiving sent rays, determining response time period of fire tubes activated as a result of alarm signal, calculating total system (detector and tube) activation time subject to said alarm and activation periods;
- a triggering mechanism (3) of button etc. activating/deactivating control unit, bringing shutter (11) to open/close position.

In an embodiment of the invention, a screen (4) located on device box (5) receives data obtained in the control unit and displays to the user.

In a preferred embodiment of the invention, IR light source (8) and/or UV light source (10) is used as light source. Said light sources are located on IR light source card and UV light source card (9) and driven by said cards.

In a preferred embodiment of the invention, the control unit comprises shutter driver circuit (12) in device box (5). Triggering mechanism (3) which is a button located on preferably handle (2) controls shutter (11) by means of shutter driver circuit (12) when alerted. Lock (15) located in front section of front lid (13) fixes light sources to device box (5). The device box (5) is made from fireproof material and thus protects components provided therein against fire and external factors.

In a preferred embodiment of the invention, said control unit also comprises an alarm detection and measurement circuit (7). The circuit (7) determines the time period in which detector detects radiations transmitted from IR and UV sources (8, 10) and reaching it and gives alarm by means of signals given by wire connection and/or wireless communication unit (Wifi, Bluetooth etc.)

provided on the connection member (6).

In a preferred embodiment of the invention, connection member (6) is used as connection point providing connection of shutter test device (1) to detector and tubes in fire extinguishing system to receive data.

The alarm detection and measurement circuit (7) of the invention measures the time period in which tubes are activated upon alarm response. Activation of tubes is the discharge of gas therein in line with the received signal as a result of fire detection. The signal is transmitted to the test device (1) via cable or wireless.

Operating principle of the test device (1) is as follows: shutter driver circuit (12) is activated by triggering mechanism (3) alerted by audio or physical interaction and the shutter (1) opens and passage of IR and UV light sources (8, 10) located behind it through obstacle and preferably passed through CaF2 glass (14) and reach the detectors. Upon activation of the triggering mechanism (3), the control unit takes the shutter (11) opening time as starting point and starts to receive data from detectors and tubes where connected. These data contain the information of the time period in which the detectors response to the radiations obtained by alarm detecting and measurement circuit (7) in the control unit and sent to light sources and the response to said radiations by detectors and the time in which tubes are activated. The said data are of the capability to detect millisecond periods and calculates the time period in milliseconds in which detectors detect the radiation dispersed upon opening of shutter (11) by alarm detection and measurement circuit (7), and the time in milliseconds in which tubes are activated. By means of such calculations it is tested whether detectors run or run in the intended level, and detectors are put into maintenance or continued to be used according to data read in LCD screen (4).

I claim:

1. A testing device for determining whether a fire extinguishing system operates and for determining a time period in which the fire extinguishing system takes action, the fire extinguishing system having a fire extinguishing tube and a detector that detects flame-spectrum generated ultraviolet (UV) wavelengths and infrared (IR) wavelengths, the testing device comprising:

- an IR or UV light source that emits radiation at different wavelengths that can be detected by the detector of the fire extinguishing system;
- a shutter positioned in front of said IR or UV light source, said shutter being openable and closable so as to control a reach of the radiation emitted by said IR or UV light source;
- a control unit adapted to receive an alarm signal generated by the detector that receives the radiation from said IR or UV light source, said control unit determining a response time of the fire extinguishing tube that is activated by the alarm signal, said control unit calculation a time period that the fire extinguishing tube is activated, said control unit connected to said shutter so as to control an opening and a closing of said shutter;
- a communication unit connected to said control unit and adapted to be connected to the detector and to the fire extinguishing tube so as to perform data exchange between said control unit and the detector and the fire extinguishing tube; and
- a triggering mechanism connected to said control unit so as to activate said control unit in order to bring said shutter to an open position or a closed position.

2. The testing device of claim 1, further comprising:

- a screen positioned on a device box and adapted to receive and display data generated by said control unit.

3. The testing device of claim 1, further comprising:

- a glass positioned on a front lid of said IR or UV light source so as to allow IR or LTV radiation from said IR or UV light source to pass without dispersion therethrough toward the detector.

4. The testing device of claim 3, wherein the glass is formed of calcium fluoride.

5. The testing device of claim 1, wherein said triggering mechanism is a button.

6. The testing device of claim 1, wherein said communication unit is a wireless communications unit.

7. The testing device of claim 2, wherein said communications unit has a connection cable inserted into a connection member on the device box and adapted to be connected to the detector and the fire extinguishing tube.

8. The testing device of claim 1, said control unit comprising:

an alarm detection and measurement circuit that measures a time period in which the detector detects the radiation delivered to the detector from said IR or UV light source and a time period that the fire extinguishing tube is activated in response to the alarm signal; and a shutter driver circuit connected to said shutter so as to control the opening and the closing of said shutter upon triggering by said trigger mechanism.

* * * * *